United States Patent [19]

Kanno et al.

[11] Patent Number: 5,074,083

[45] Date of Patent: Dec. 24, 1991

[54] CLEANING DEVICE USING FINE FROZEN PARTICLES

[75] Inventors: Itaru Kanno; Takaaki Fukumoto; Toshiaki Ohmori, all of Itami City, Japan

[73] Assignee: Mitsubishi Denki Kabushiki Kaisha, Japan

[21] Appl. No.: 653,960

[22] Filed: Feb. 12, 1991

[30] Foreign Application Priority Data

Feb. 14, 1990 [JP] Japan ..... 2-31547

[51] Int. Cl.[5] ..... B24C 3/00

[52] U.S. Cl. ..... 51/410; 51/165.73; 51/430

[58] Field of Search ..... 51/410, 424, 425, 426, 51/428, 430, 320, 321, 322, 310, 165.73

[56] References Cited

U.S. PATENT DOCUMENTS

| | | | |
|---|---|---|---|
| 3,702,519 | 11/1972 | Rice et al. | 51/322 |
| 3,824,739 | 7/1974 | Moret et al. | 51/424 |
| 4,389,820 | 6/1983 | Fong et al. | 51/410 |
| 4,655,847 | 4/1987 | Ichinoseki et al. | 51/410 |
| 4,680,900 | 7/1987 | Wadephul et al. | 51/430 |
| 4,744,181 | 5/1988 | Moore et al. | 51/322 |
| 4,793,103 | 12/1988 | Baumgart | 51/426 |
| 4,924,643 | 5/1990 | Buiquez et al. | 51/322 |
| 4,958,466 | 9/1990 | Howells | 51/426 |
| 4,977,910 | 12/1990 | Miyahara et al. | 51/410 |
| 5,009,240 | 4/1991 | Levi . | |

*Primary Examiner*—M. Rachuba

*Attorney, Agent, or Firm*—Leydig, Voit & Mayer

[57] ABSTRACT

A cleaning device using fine frozen particles electrically charges the fine frozen particles produced by atomizing a liquid within a refrigerated atmosphere, controlling the speed, direction and divergence of the charged particles to cause them to strike a desired portion of an object to be cleaned. All of these operations are performed in a variable degree of vacuum. Thus, the speed, direction and divergence of the particles and the particle grain size can be precisely controlled.

6 Claims, 2 Drawing Sheets

CLEANING DEVICE USING FINE FROZEN PARTICLES

BACKGROUND OF THE INVENTION

1. Field of the Invention

This invention relates to a cleaning device using fine frozen particles, which performs cleaning by spraying fine frozen particles, obtained by freezing water or the like, on an object to be cleaned.

2. Description of the Related Art

FIG. 2 is a side cross sectional view schematically showing the internal structure of a conventional cleaning device using fine frozen particles. The device shown includes an ice making section 10 equipped with a double-walled ice making container 1 composed of an inner and an outer ice making hopper 1*a* and 1*b*. The inner space of the inner ice making hopper 1*a* is refrigerated by a refrigerant 2 such as liquid nitrogen, and the space between the inner and outer ice making hoppers 1*a* and 1*b* is also filled with refrigerant 2, thus refrigerating the inner ice making hopper 1*a* from the outside as well. Liquid, such as extrapure water, is sprayed through a spray nozzle 3 into the inner ice making hopper 1*a* and is frozen so as to become fine frozen particles 4. A cleaning section 20 is equipped with a cleaning container 7, in which the fine frozen particles 4 produced in the ice making section 10 are sprayed on an object 6 to be cleaned by means of a spray gun 5.

The operation of this device will now be described. The inner space of the inner ice making hopper 1*a* is refrigerated by the refrigerant 2 filling the space between the outer and inner ice making hoppers 1*a* and 1*b* as well as by the refrigerant injected into the inner ice making hopper 1*a*. When, in this condition, liquid is sprayed by the spray nozzle 3, fine frozen particles 4 are produced. The thus produced fine frozen particles 4 are transferred to the spray gun 5, which is of the ejector type using a carrier 2*a* such as nitrogen or compressed dry air. By the jet stream force of the carrier gas 2*a*, the fine frozen particles 4 are sprayed on the object 6 to be cleaned, thereby cleaning the surface of the object 6. The fine frozen particles 4 sprayed from the spray gun 5, the carrier gas 2*a*, etc. are discharged out of the cleaning container 7 through an exhaust outlet 8. Accordingly, the fine particles 4 hit the surface of the object 6, causing any contaminants (not shown) thereon to be removed and discharged out of the container. The speed at which the fine frozen particles are sprayed by the spray gun 5 is adjusted by controlling the jet pressure of the carrier gas 2*a*. Further, the divergence of the spray steam of the fine frozen particles 4 from the spray gun 5 is determined by the configuration of the jet nozzle (not shown) of this spray gun 5.

Because of the above-described conventional cleaning devise using fine frozen particles employs an ejector-type spray gun, which utilizes a carrier-gas jet stream as the means of spraying the fine frozen particles on the object to be cleaned, it has been difficult to precisely control the speed, direction and divergence of the spray stream as well as the grain size of the fine frozen particles. Further, during the spraying, the jetting of the carrier gas causes the airflow inside the cleaning section to be disturbed, with the result that the contaminants removed from the object are blow around, thus allowing them to adhere to the object again.

SUMMARY OF THE INVENTION

This invention has been made with a view to solving the problems mentioned above. It is accordingly an object of this invention to provide a cleaning device of the type using fine frozen particles in which the speed, direction and divergence of the spray stream and the grain size of the frozen particles are finely controlled when spraying the fine frozen particles using the spray gun, thereby enhancing the cleaning effect, protecting the object to be cleaned from damage, and preventing any contaminant once removed from adhering to the object again.

In order to achieve the above object, this invention provides a cleaning device using fine frozen particles, comprising: an ice making means for producing fine frozen particles by atomizing a liquid to be frozen within a refrigerated atmosphere; spray control means for electrically charging the fine frozen particles produced by the ice making means and for accelerating the charged fine frozen particles electrically and, further, for controlling the spray direction of the particles as well as the divergence of the particles before the particles impact an object to be cleaned; and a vacuum exhaust means for creating a variable degree of vacuum in the space which the fine frozen particles are produced and sprayed on the object and for discharging the contaminants removed from the object as well as the expended frozen particles from space.

According to the present invention, the speed, direction and divergence of the fine frozen particles and the degree of vacuum are precisely controlled, thereby enhancing the cleaning process as well as protecting the object to be cleaned from damage. Further, by performing the processes in an evacuated space, a contaminant once removed from the object to be cleaned is prevented from adhering to it again.

DESCRIPTION OF THE PREFERRED EMBODIMENTS

Figure 1:
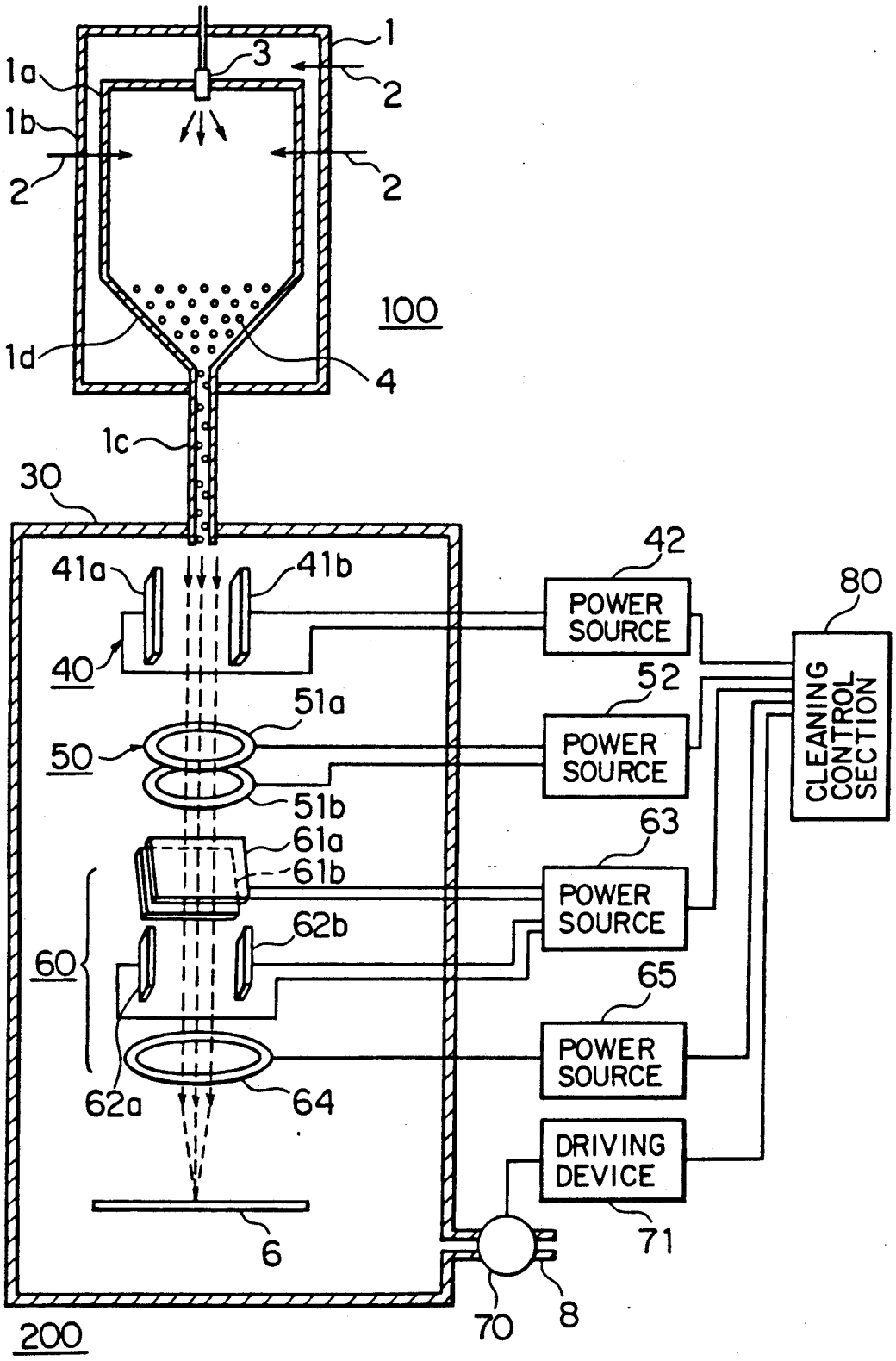
FIG. 1 shows a schematic perspective view of the internal structure of a cleaning device using fine frozen particles in accordance with an embodiment of this invention.
Figure 2:
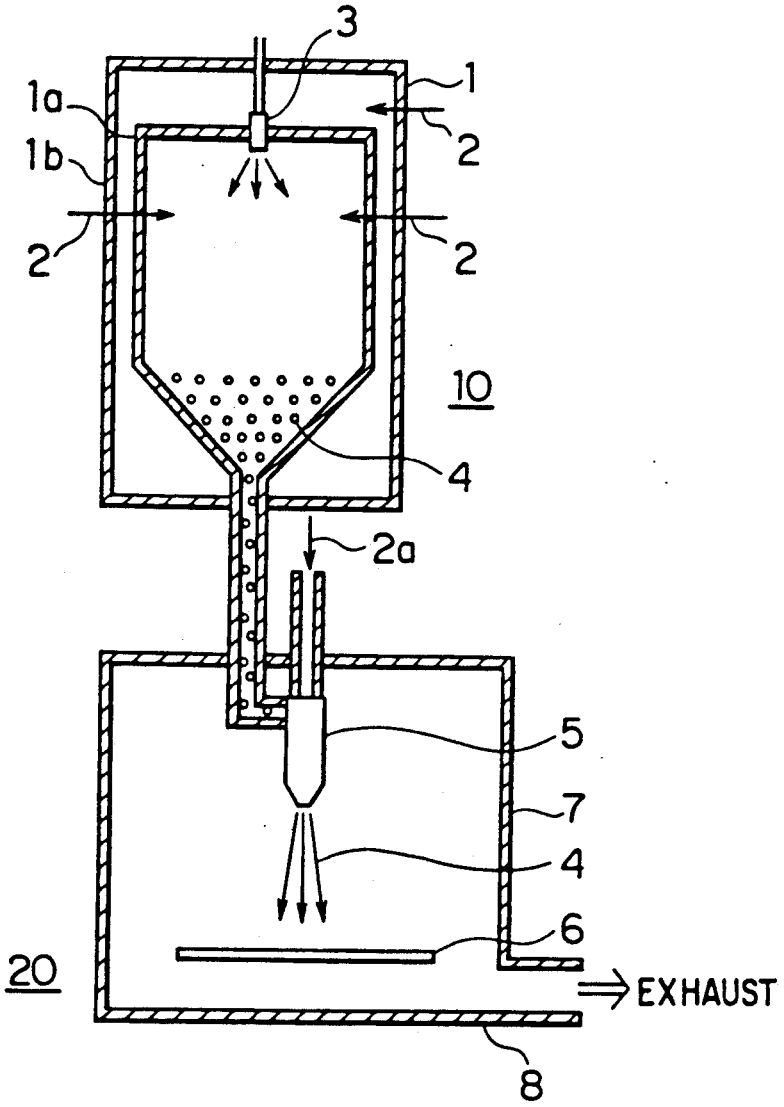
FIG. 2 PRIOR ART
FIG. 2 shows a side cross sectional view of the internal structure of a conventional cleaning device using fine frozen particles.

An embodiment of this invention will now be described with reference to the accompanying drawing. FIG. 1 shows a schematic perspective view of the internal structure of a cleaning device in accordance with an embodiment of this invention. In the drawing, the construction of the ice making container 1 of the ice making section 100 is substantially the same as the conventional one shown in FIG. 2. However, as will be described below, the inner ice making hopper 1*a* of this invention is maintained at a reduced pressure, so that it must be airtight and strong. The fine frozen particles 4, produced in the ice making container 1, are guided to a supply pipe 1*c* by virtue of the inclined surface of the funnel portion in the lower section of the inner ice making hopper 1*a*, pass through the supply pipe 1*c* to reach the top section of a vacuum cleaning container 30 of the cleaning section 200, and drop therefrom. Accordingly, the ice making container 1 must be physically situated above the vacuum cleaning container 30. Provided in the vacuum cleaning container 30, starting from the outlet of the supply pipe 1*c*, are a charging section 40, an accelerating section 50, and an ice particle divergence control section 60, with the object 6 to be cleaned being placed therebelow. The charging section 40 is composed of two parallel flat electrodes 41*a* and 41*b* and a power source 42 for producing a discharge between the two electrodes 41*a* and 41*b*, thereby charging the fine frozen particles 4 passing therebetween. The accelerating section 50 is composed of two ring-like electrodes 51*a* and 51*b* and a power source 52 for accelerating the charged fine frozen particles 4 passing through their ring-like sections. The ice particle divergence control section 60 is composed of: a pair of X-direction parallel electrode plates (61*a* and 61*b*) and a pair of Y-direction parallel electrode plates (62*a* and 62*b*) for controlling the particles with respect to the X and Y directions in a horizontal plane, i.e., a plane perpendicular to the direction in which the particles 4 move; a power source 63 for applying electrical signals to these electrodes; an electromagnetic lens 64 for controlling the divergence of the particles 4; and a power source 65 for supplying an electrical current to lens 64. Further, a vacuum exhaust pump 70 provided at the exhaust outlet 8 discharges air so that all the processes may be performed in a reduced pressure condition, including those that take place in the space within the inner ice making hopper 1*a* of the ice making container 1 and in the space within the vacuum cleaning container 30, i.e., the processes including the production of the particles 4 and the spraying of the particles on the object 6. Accordingly, it is necessary for the supply pipe 1*c* to be attached to the container 30 so that the reduced pressure is maintained. Further, the exhaust pump 70 is connected to a driving device 71. A cleaning control section 80 controls the respective power sources 42, 52, 63 and 65 of the charging section 40, the accelerating section 50, and the ice particle divergence control section 60 as well as the driving device 71 of the vacuum exhaust pump 70, thus effecting general control.

Next, the operation of this cleaning device will be described. The liquid to be frozen such as extrapure water sprayed from the spray nozzle 3 is turned into fine frozen particles 4 in the inner ice making hopper 1*a* by using a refrigerant 2 as described above. The ice particles 4 are guided by the supply pipe 1*c* and dropped from the uppermost section of the vacuum cleaning container 30. Next, the particles are charged by the parallel flat electrodes 41*a* and 41*b* of the charging section 40 while passing therebetween. The charged particles 4 are then accelerated by the accelerating section 50, where a DC current is applied from the power source 52 to the two ring-like electrodes 51*a* and 51*b* so as to generate between these electrodes an electric field, which accelerates the charged particles 4. By controlling the applied voltage, the speed of the particles 4 can be controlled. Next, when the accelerated particles 4 pass through the two pairs of parallel electrode plates (61*a*, 61*b* and 62*a*, 62*b*) of the ice particle divergence control section 60, position control is effected with respect to the X- and Y-directions in a plane perpendicular to the direction in which the particles move. Further, the particles 4 are controlled in terms of their particle divergence when passing through the electromagnetic lens 64 of the ice particle divergence control section 60 before they are allowed to strike a desired portion of the object 6 to be cleaned. The contaminant (not shown) on the object 6 to be cleaned is removed therefrom by the following processes: the direct impingement of the particles 4 on the object 6; the scattering of ultrafine frozen particles which are generated on the surface of the object 6 when the particles 4 impinge thereon, and the low-temperature effect given by the particles 4. The low-temperature cleaning effect of the fine frozen particles 4 is derived from the cold temperature of the particles, which, in the case where the contaminant is an oil or the like, solidifies the oil to make it easier to remove than when it is in a liquid state. The contaminant removed from the object 6 to be cleaned, the expended frozen particles, etc. are discharged out of the container 30 by the vacuum exhaust pump 70. Further, it is desirable that the lower inner section of the cleaning container 30 have a structure that will enable the contaminant and the expended particles 4 to be easily discharged through the exhaust outlet 8 although no suggestion in this regard is given in the drawing.

Thus, in the cleaning device of this invention, the speed, direction and divergence of the particles are finely controlled, thereby defining with more precision the portion of the object to be cleaned where the particles will strike. Further, all the processes (from the production of fine frozen particles to the cleaning of the object) are performed in containers at a reduced pressure, so that there is little possibility of any contaminant getting in during the cleaning operation. Further, since no turbulent airflow is generated in the containers, there is no risk that the contaminant once removed from the object to be cleaned will adhere to it again. Thus, it is possible to perform cleaning with a high degree of efficiency. Further, particle control is easy since it is performed in a reduced pressure condition. Generally speaking, the control of the grain size of the particles 4 is effected by varying the configuration of the spray nozzle 3. However, finer control of the particle grain size is possible by changing the degree to which the particles are sublimated. This can be effected by varying the degree of vacuum in the containers through adjustment of the vacuum exhaust pump 70, or by adjusting the speed of the particles 4 by controlling the voltage applied to the accelerating section 50, thereby varying the time it takes the particles 4 in the ice making container 1 to reach the object 6 to be cleaned. This grain size control, combined with the adjustment of the particle speed, makes it possible to protect the object to be cleaned from damage. The above control operations are performed by the cleaning control section 80, which effects general control over the respective power sources of the different sections as well as over the driving device 71.

While the above embodiment has been described as applied to a cleaning operation utilizing fine frozen particles, it is also possible to apply this invention to the patterning of a photoresist on a semiconductor substrate by utilizing the particle spray control. In that case, the photoresist on a silicon substrate can be removed by spraying particles thereon, i.e., patterning can be effected by narrowing the particle jet stream into a beam so as to partially remove the photoresist.

Thus, in the cleaning device of this invention, fine frozen particles produced by atomizing a liquid within a refrigerated atmosphere are electrically charged, and their speed, direction and divergence are controlled so as to cause them to impinge upon the desired portion of the object to be cleaned, all the operations being performed in containers under reduced pressure. Accordingly, the speed, direction and divergence of the particles and the grain size can be precisely controlled, thereby making it possible to perform cleaning with a high degree of efficiency while ensuring that the object to be cleaned is not damaged.

What is claimed is:

1. A cleaning device comprising:

ice particle making means for producing fine frozen particles;

spray control means for electrically controlling the acceleration, velocity, direction, and dispersion of fine frozen particles produced by said ice particle making means before the particles collide with an object to be cleaned; and vacuum exhaust means for creating a variable pressure volume in which the production of fine frozen particles, the spraying of the particles on the object, and exhaust of contaminants removed from said object are carried out at a reduced pressure.

2. A cleaning device as claimed in claim 1 wherein said ice particle making means includes a spray nozzle for atomizing a liquid to be frozen and a refrigerated ice making container receiving the atomized liquid;

said spray control means includes a charging section for electrically charging fine frozen particles produced by said ice particle making means, an accelerating section for electrically accelerating the charged fine frozen particles, and an ice particle divergence control section for electrically controlling the divergence of the charged fine frozen particles in a plane; and said vacuum exhaust means includes a cleaning container for housing the object to be cleaned in communication with said ice making container and a vacuum exhaust pump for evacuating said ice making container and said cleaning container and for exhausting contaminants removed from the object and expended frozen particles from said cleaning container.

3. A cleaning device as claimed in claim 2 including a first power supply for providing an electrical signal to said charging section for electrically charging the fine frozen particles, a second power supply for providing an electrical signal to said accelerating section for accelerating the charged fine frozen particles, and a third and a fourth power supply for supplying respective electrical signals to the particle divergence control section for controlling divergence of the charged fine frozen particles.

4. A cleaning device as claimed in claim 2 wherein said ice particle making means includes inner and outer ice making hoppers, the space between said inner and outer ice making hoppers receiving a refrigerant, a supply pipe connecting said inner ice making hopper to said cleaning container, said inner ice making hopper having a funnel for guiding the fine frozen particles with gravitational force into said supply pipe; and said charging section includes two parallel flat electrodes for electrically charging the fine frozen particles, said accelerating section includes two annular electrodes for electrically accelerating the charged fine frozen particles, and said ice particle divergence control section includes two pairs of flat electrode plates for electrically controlling the positions of the charged fine frozen particles in a plane, and an electromagnetic lens for electrically controlling the divergence of the particles.

5. A cleaning device using fine frozen particles as claimed in claim 1 wherein said object to be cleaned is a semiconductor substrate having a photoresist on its surface, patterning of said semiconductor substrate being performed by narrowing down the divergence of said fine frozen particles into a beam and applying it to said photoresist so as to partially remove the same.

6. A cleaning device as claimed in claim 3 comprising cleaning control means for controlling said first, second, third, and fourth power supplies and said vacuum exhaust pump for varying the time from the freezing of a particle until the particle reaches the object, thereby precisely controlling the speed and size of the particle.

* * * * *